United States Patent [19]

Smith

[11] 4,402,269

[45] Sep. 6, 1983

[54] ELECTRIC DELAY DETONATOR

[75] Inventor: Rex L. Smith, Ridgecrest, Calif.

[73] Assignee: The United States of America as represented by the Secretary of the Navy, Washington, D.C.

[21] Appl. No.: 278,026

[22] Filed: Jun. 29, 1981

[51] Int. Cl.[3] ..... F42C 19/02; F42C 11/00

[52] U.S. Cl. ..... 102/202.13; 102/202.5; 102/202.14

[58] Field of Search ..... 102/202.5, 202.13, 202.14, 102/204, 275.9, 277.1, 200, 202.9, 202.12; 149/37, 42

[56] References Cited

U.S. PATENT DOCUMENTS

| | | | |
|---|---|---|---|
| 2,506,157 | 5/1950 | Loret | 102/28 |
| 3,062,143 | 11/1962 | Savitt et al. | 102/28 |
| 3,078,799 | 2/1963 | Kabik | 102/28 |
| 3,082,691 | 3/1963 | Evans et al. | 102/202.14 |
| 3,158,097 | 11/1964 | Brockway et al. | 102/28 |
| 3,352,237 | 11/1967 | Turquois | 102/28 |
| 3,726,217 | 4/1973 | Dedman et al. | 102/28 R |
| 3,978,791 | 9/1976 | Lemley et al. | 102/28 R |
| 3,999,484 | 12/1976 | Evans | 102/28 R |
| 4,144,814 | 3/1979 | Day et al. | 102/28 R |

*Primary Examiner*—Charles T. Jordan
*Assistant Examiner*—Ted L. Parr
*Attorney, Agent, or Firm*—Robert F. Beers; W. Thom Skeer; Kenneth G. Pritchard

[57] ABSTRACT

A delay detonator made from an inner and outer casing combination which reduces the number of individual components. The detonator uses reduced volume with increased pressure to permit control of the pyrotechnic delay mix. The amount of free space to start combustion is limited as compared to previous delay detonators. An overlapping lip arrangement of the inner and outer casing and an inner sleeve permit welding at the outer edge to permanently lock the distance between detonator components.

7 Claims, 2 Drawing Figures

ELECTRIC DELAY DETONATOR

BACKGROUND OF THE INVENTION

1. Field of the Invention

This invention relates to improved delay detonator devices. Specifically, the present invention refers to delay detonators capable of withstanding high impact. Such delay detonators use an internal arrangement of components to rigidly lock separation distances between active components.

2. Description of the Prior Art

Delay detonators have been used in ordnance for many decades. For impact resistant warheads, the delay detonator shown in FIG. 1 represents current state of the art. This current state of the art has been known for approximately a quarter of a century. In FIG. 1, an outer casing 11 which can be made of metal, is used to hold the delay detonator components. As shown in FIG. 1, casing 11 only has a single open end. At the bottom of casing 11 detonation material is placed that provides the output function of the detonator. As shown in FIG. 1, two separate materials are used to make up the detonation material. At the very bottom of the casing, material 12 can be a standard explosive such as RDX and material 14 can be another material such as lead azide. The reason for the two different compounds is that the lead azide burns or detonates at a relatively high temperature and pressure. This detonation/burning then detonates the RDX. RDX provides the high impulse required for detonation of the next element in the explosive train.

The next component placed inside outer casing 11 is the sleeve insert 16. Sleeve insert 16 is made of metal and is slid down the inside of outer case 11 until it either contacts detonation material 14 or leaves a very slight space 18 as shown. Sleeve 16 has a limited aperture 20 whose function will be described later. Within space 22, in sleeve insert 16, the pyrotechnic delay mix 24 is inserted. Pyrotechnic delay mix 24 can be any suitable material which ignites and burns rather than detonates. Pyrotechnic delay mix 24 is usually sandwiched between holding devices 26 which can be either screen wire mesh, paper, or other suitable material. In either case, the function is to serve as a flame holder both for the entrance into and exit from pyrotechnic delay mix 24. A washer 28, which serves as an access piece to pyrotechnic delay mix 24, is then placed against one of the holding devices 26 as shown. Washer 28 may be metal, plastic, etc. Most of the volume of space 22 is left empty. This volume serves as a combustion chamber and provides the free volume that is necessary for stable combustion. The use of washer 28 at the end of the combustion chamber section limits the amount of burning/detonation materials that may be passing through space 22, as will be described further on. At the end of inner sleeve 16, a spacer 30 is placed. Spacer 30 can be made of metal, plastic, etc. As shown, spacer 30 is a cylindrical device with an aperture at one end and a matching diameter to inner sleeve 16 on the other end. Spacer 30 serves as both a holder and a throttle down device to attenuate energy into space 22.

Holding spacer 30 in proper position with inner sleeve 16 is an outer sleeve 32. Outer sleeve 32 is also made of metal or plastic. Within outer sleeve 32 and across the apertured end of spacer 30, a thin layer of paper 34 is placed. Thin paper 34 can serve as a flameholder/charge retainer in a similar fashion to holding devices 26 previously described. Holding paper 34 in place is a washer shaped device 36 which is made of plastic or any similar material. This material is filled with an igniter charge 38 placed directly against paper 34. On the opposite side of igniter charge 38 is a bridgewire mix 40. In turn, a bridgewire 56 is placed against bridgewire mix 40. Attached to bridgewire 56 are two wire leads 42 which in turn are attached to an electrical energy source 44. Holding device 36 in place is a sleeve 46 which fits within outer sleeve 32 and presses against the edges of device 36 as shown. Sleeve 46, which can be metal or plastic, is filled with glass 48. This glass-to-metal mixture serves as a stable holder that holds leads 42, sleeve 46, bridgewire 56, bridgewire mix 40, igniter charger 38, and device 36 in a fixed position. Spaces 50 and 52 have intentionally been left vacant.

Upon an electrical signal, leads 42 transmit the signal to bridgewire 56 which is heated and then ignites bridgewire mix 40. Bridgewire mix 40 in turn is detonated and then ignites the igniter charge 38 which has a controlled flame front. The flame front passes through paper 34 and spacer 30. The limitation provided by spacer 30 permits only a small fraction of the detonation particles from igniter mix 38 to pass into volume 22. The particles which reach volume 22 dissipate part of their collective energy in volume 22. The number of particles that pass into pyrotechnic delay mix 24 is decreased by washer 28. Flameholders 26 insure a uniform flame front into the pyrotechnic delay 24 and a uniform flame front out of pyrotechnic delay mix 24. The internal configuration of the components within inner sleeve 16 is to avoid misfires by either having detonation products from igniter mix 38 punch through pyrotechnic delay mix 24 and into detonation materials 12 and 14 and thus defeat the delay time desired or else the massive combustion of the detonation into volume 22 would be over so fast that pyrotechnic delay mix 24 would fail to ignite.

SUMMARY OF THE INVENTION

The present invention improves the reliability of delay detonators by removing numerous internal components which were previously thought to be needed to insure operability. In particular, the flame holding spacer has been removed and the combustion chamber volume has been radically decreased. Although the reduction in combustion chamber volume produces much higher pressures than previously thought desirable, the duration of the pressure is so brief that proper functioning of the device still occurs. Removal of the spacer which served as a throttle down device permits an inner and outer casing to be used with overlapping lips to permit a fixed position of the internal components. Such a rigid fit improves detonator reliability when the detonator is subjected to impacts.

Accordingly it is an object of the present invention to provide an improved delay detonator which is both more reliable than previous delay detonators and simpler in design and construction than previous detonators.

DESCRIPTION OF THE PREFERRED EMBODIMENT

Figure 1:
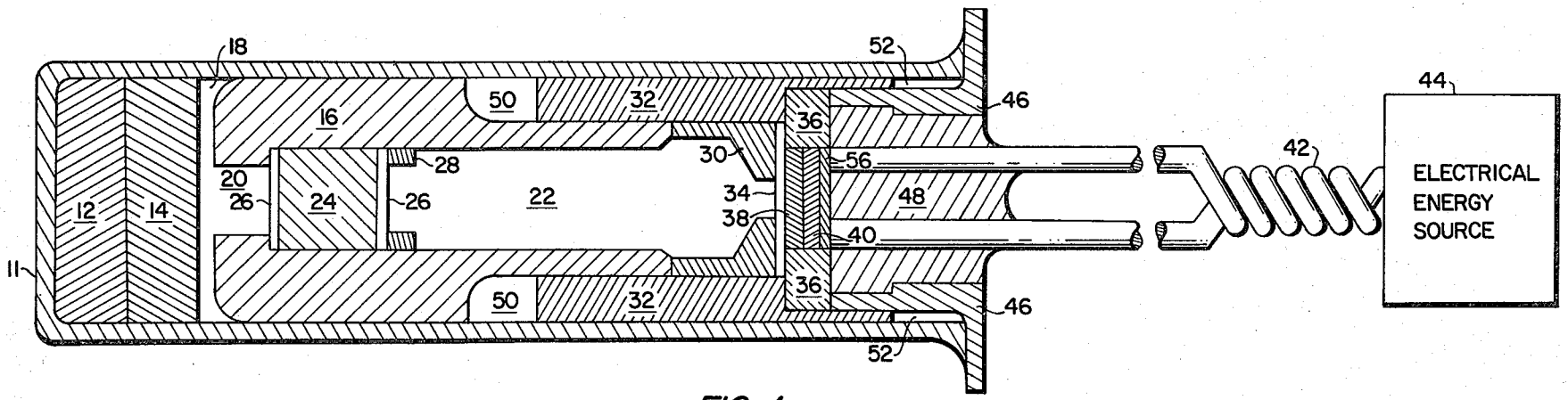
FIG. 1 Prior Art
FIG. 1 is a cross section of a prior art delay detonator.
Figure 2:
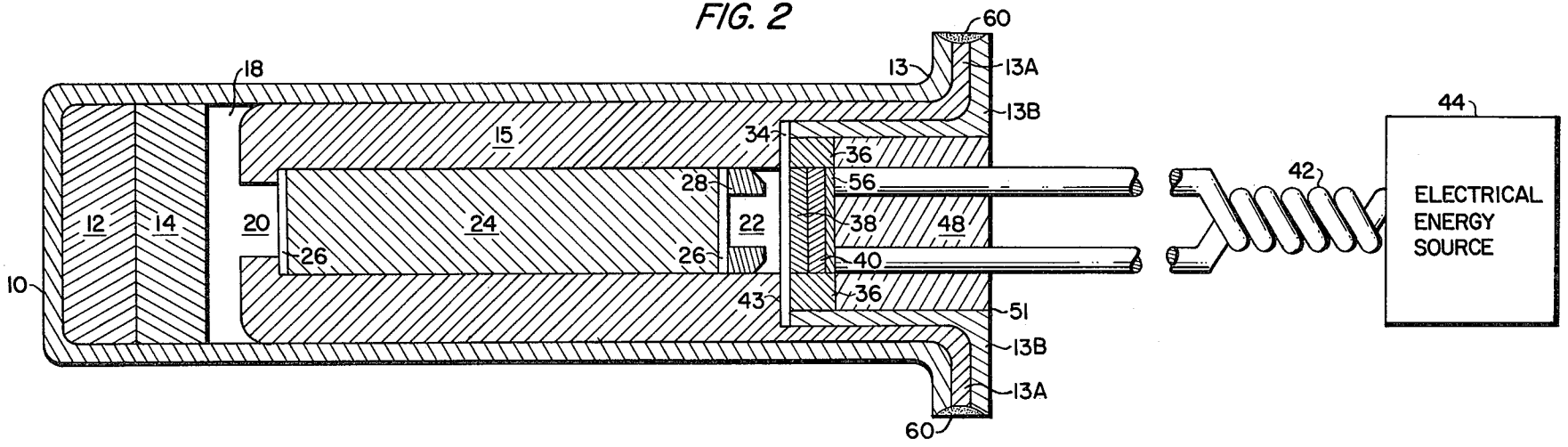
FIG. 2 is a cross section of the present invention delay detonator.

FIG. 2 is a cross section of the present invention. Numbers of components similar to FIG. 1 have been retained for comparison purposes. Like numbers refer to components which remain identical.

In FIG. 2 an outer casing 10 is shown. Outer casing 10 is similar to prior art devices except an intentional L-shaped lip 13 is placed at the open end of outer casing 10. This contrasts with the outer casing 11 of FIG. 1 which shows a deformed outer edge. While this edge may be construed as a lip, it does not have a specific configuration as required in the present invention. Other configurations of the lip are possible, but predictable uniformity is required as will become clear shortly. The detonation material is placed at the bottom of outer casing 10 and can be composed of two separate compounds as previously described. Once again, a bottom mixture of RDX for material 12 covered by lead azide 14 may be used. The remaining space above detonation materials 12 and 14 is now filled by a single piece inner casing 15. Inner casing 15 has an aperture 20 and has corresponding lip 13A which forms a well-machined fit with lip 13 of outer casing 10. Predetermined space 18 is left between detonation material 14 and inner casing 15. Within inner casing 15 there is an internal volume 22.

Unlike the prior art device, which required most of this volume to remain empty space, the present invention fills most of this volume with pyrotechnic delay mix 24. Pyrotechnic delay mix 24 is any of numerous pyrotechnic delay mixes known in the art. One example of a working material is molybdenum/potassium perchlorate. Both ends of pyrotechnic delay mix 24 are covered with flameholders 26 which were described for FIG. 1. On one end of pyrotechnic delay mix 24, the far end from detonation material 14, a washer 28 is again inserted to serve as a throttling down device.

Inner casing 15 is contoured to have shoulder 43. Shoulder 43 permits the device to be assembled in a straightforward manner without the buildup of components shown in FIG. 1. Within inner casing 15, a layer of thin paper 34 is placed on shoulder 43 to cover the opening of volume 22. It is emphasized that no spacer or other throttling down device is put across the remaining end of volume 22. Paper 34 is held in place by a subassembly. The subassembly includes an igniter charge 38, a washer 36, bridgewire mix 40, bridgewire 56, leads 42, glass 48, and an insert 51. The bridgewire mix can be basic lead styphnate. The igniter charge can be a zirconium lead dioxide mixture or other suitable material. The upper surface of bridgewire mix 40 is in contact with a bridgewire 56. Wire leads 42 are attached to bridgewire 56 and in turn to an electrical source 44. Glass-to-metal spacer 48 is again used to provide a stable base for leads 42, bridgewire 56, bridgewire mix 40, and igniter charge 38. For simplicity of manufacture, all of these components are put in insert 51 which fits within inner casing 15 as shown. Insert 51 has a conformed lip 13B such that lips 13, 13A, and 13B form a snug fit. The outer edges of these three lips are then welded together, as shown by welding bead 60. Solder can be used by proper design of the joint. The edges could also be held in place by crimping.

The present invention avoids spaces 50 and 52 shown in FIG. 1. Spaces 50 and 52 can be filled by appropriate machining of extra material to fill such areas. As a practical manner, tight tolerances among multiple pieces in small detonators are impractical. Numerous machinings are required to get all components to fit properly. In ordnance devices, impact on hard surfaces such as steel, concrete, etc., cause the components to move. Internally, the spaces shown deform and change the arrangement of components. The inevitable result is a rate of misfire which in numerous applications is unacceptable.

The present device limits the amount of internal damage or deformation that can occur. There are no internal metal devices, such as inner sleeve 16 or metal spacer 30, which rely on friction fittings to hold them in place. In particular, inner casing 15 of FIG. 2 is unable to shift forward upon impact as inner sleeve 16 of FIG. 1 is capable of doing. This is because of the overlapping lip fit possible by the use of a single piece of material. Further welding of the metal components at the lips insures a strong rigidity between individual components not previously attainable.

The parts shown in FIG. 2 can be made of metal, plastic or other suitable material. Burning rates change if plastic is used instead of metal. This is due to a different heat flow rate into the plastic. The added depth of inner casing 15 strengthens the ability to attenuate shock along or across the device. The improved structural integrity attenuates shock signals. The shock signal is usually caused either by detonation or impact. The use of dissimilar materials between outer casing 10 and inner casing 15, such as one plastic and one metal, improves the ability to dissipate shock by adding a further discontinuity. A further alternate, not shown, is to insert a sleeve of dissimilar material between the inner and outer casings.

The present invention specifically contradicts established state of the art beliefs about such delay detonation devices. First, the throttle down device on the side next to igniter charge 38 is removed. In the present invention, the entire igniter charge is permitted to detonate into volume 22 unhindered. Second, a relatively small amount of volume for space 22 causes increased pressure as pyrotechnic delay mix 24 begins combustion. Thus, in the present invention, the amount of combustion chamber provided appears to be inadequate. Stress tests show that pressures as high as 5000 psi do occur in the present invention. However, these high pressures do not hinder performance. The amount of pyrotechnic delay mix 24 in the detonator is significantly increased. The increased pressure causes an increased burning rate. The extra depth of pyrotechnic delay mix 24 does not have a significant variation on the delay time because of the compensating increase in burning rate. In addition, as pyrotechnic delay mix 24 is consumed, the amount of combustion chamber volume available grows and reduces pressure.

The transition from ignition to detonation to ignition is started by bridgewire mix 40 through igniter charge 38 to pyrodelay mix 24. This takes place within inner casing 15, a machined metal delay housing. Inner casing 15 has shoulder 43 which supports paper disk 34 and the subassembly with igniter charge 38. Once pyrotechnic delay charge 24 burns, the transfer is from combustion to an intermediate charge 14 and then to a base charge 12. All the aforementioned charges are of a precalculated size and composition as described. Bridgewire 56 is very small and can be as small as 0.0005 inches in diameter. This is commonly made of nichrome or other heater wire. The addition of a current through signal leads 42 quickly varporizes bridgewire 56 and ignites bridgewire mix 40.

It will be obvious to those skilled in the art that numerous modifications of the components as described above can be made.

What is claimed is:

1. A delay detonator comprising:

an outer casing with a lip at the only open end of said outer casing;

detonation material placed at the closed end of said outer casing for detonating upon the occurrence of a predetermined event;

an inner casing with two open ends, one open end having a lip that conforms to the lip of the outer casing when said inner casing is inserted into said outer casing, said inner casing terminating a set distance from said detonation material;

a pyrotechnic delay mix placed in said inner casing a set distance from said detonation material for igniting said detonation material;

an igniter charge placed in said inner casing a set distance from the pyrotechnic delay mix for igniting said mix;

an access piece placed between the pyrotechnic delay mix and the igniter charge for restricting the ability of said igniter charge to punch through said mix;

a bridgewire mix next to said igniter charge for detonating said igniter charge;

signal leads electrically connected to said bridgewire mix for igniting said bridgewire mix; and sealing material for holding said signal leads, bridgewire mix, and igniter charge in a fixed position with respect to the lipped ends of said outer and inner casings.

2. A delay detonator as described in claim 1 where said bridgewire mix comprises basic lead styphnate.

3. A delay detonator as described in claim 1 where said igniter charge comprises a zirconium lead dioxide mixture.

4. A delay detonator as described in claim 1 where said pyrotechnic delay mix comprises molybdenum/-potassium perchlorate.

5. A delay detonator as described in claim 1 where said sealing material comprises:

a metal insert with two open ends, one of said ends having a lip that overlaps said inner and outer casing lips when said insert is placed within said inner casing; and a glass-to-metal seal for holding said signal leads, bridgewire mix, and igniter charge in a fixed position within said metal insert.

6. A delay detonator as described in any of claims 1, 2, 3, 4 or 5 where said access piece is a metal washer.

7. A delay detonator comprising:

an outer metal casing with a lip at the only open end of said outer casing;

detonation material placed at the closed end of said outer casing for detonating upon the occurrence of a predetermined event;

an inner metal casing with two open ends, one open end having a lip that conforms to the lip of the outer casing when said inner casing is inserted into said outer casing and welded to said outer casing at the lips, said inner casing terminating a set distance from said detonation material;

a pyrotechnic delay mix of molybdenum/potassium perchlorate placed in said inner casing a set distance from said detonation material for igniting said detonation material;

an igniter charge of zirconium led dioxide placed in said inner casing a set distance from the pyrotechnic delay mix for igniting said mix;

a metal washer placed between the pyrotechnic delay mix and the igniter charge for restricting the ability of said igniter charge to punch through said mix;

a bridgewater mix of basic lead styphnate next to said igniter charge for detonating said igniter charge;

signal leads electrically connected to said bridgewire mix for igniting said bridgewire mix; and sealing material for holding said signal leads, bridge-wire mix, and igniter charge in a fixed position with respect to the lipped ends of said outer and inner casings.

* * * * *